US009190760B2

(12) United States Patent
Ma

(10) Patent No.: US 9,190,760 B2
(45) Date of Patent: Nov. 17, 2015

(54) PLUG STRUCTURE FOR CONNECTING SOCKETS

(71) Applicant: Hing Wai Michael Ma, Hong Kong (CN)

(72) Inventor: Hing Wai Michael Ma, Hong Kong (CN)

(73) Assignee: PowerCubic International Limited, Kowloon, Hong Kong (CN)

( * ) Notice: Subject to any disclaimer, the term of this patent is extended or adjusted under 35 U.S.C. 154(b) by 0 days.

(21) Appl. No.: 14/452,863

(22) Filed: Aug. 6, 2014

(65) Prior Publication Data

US 2015/0099381 A1 Apr. 9, 2015

(30) Foreign Application Priority Data

Oct. 8, 2013 (CN) ..... 2013 1 0464529

(51) Int. Cl.

| | |
|---|---|
| ***H01R 13/453*** | (2006.01) |
| ***H01R 33/92*** | (2006.01) |
| ***H01R 31/02*** | (2006.01) |
| ***H01R 13/514*** | (2006.01) |
| ***H01R 25/00*** | (2006.01) |
| ***H01R 27/02*** | (2006.01) |
| *H01R 13/443* | (2006.01) |

(52) U.S. Cl.

CPC ..... *H01R 13/4534* (2013.01); *H01R 13/514* (2013.01); *H01R 25/003* (2013.01); *H01R 27/02* (2013.01); *H01R 31/02* (2013.01); *H01R 33/92* (2013.01); *H01R 13/443* (2013.01)

(58) Field of Classification Search

CPC ..... H01R 13/4534; H01R 13/514

See application file for complete search history.

(56) References Cited

U.S. PATENT DOCUMENTS

| | | | | |
|---|---|---|---|---|
| 5,292,257 | A * | 3/1994 | Milan | 439/214 |
| 5,334,033 | A * | 8/1994 | Milan | 439/214 |
| 5,658,158 | A * | 8/1997 | Milan | 439/214 |
| 5,788,521 | A * | 8/1998 | Milan | 439/214 |
| 5,885,109 | A * | 3/1999 | Lee et al. | 439/652 |
| 6,045,399 | A * | 4/2000 | Yu | 439/502 |
| 6,220,880 | B1 * | 4/2001 | Lee et al. | 439/214 |
| 6,406,308 | B1 * | 6/2002 | Wang | 439/145 |
| 6,454,584 | B1 * | 9/2002 | Milan | 439/214 |
| 6,602,081 | B1 * | 8/2003 | Wang | 439/145 |
| 6,750,410 | B2 * | 6/2004 | Lee | 200/51.03 |
| 6,755,676 | B2 * | 6/2004 | Milan | 439/214 |

(Continued)

FOREIGN PATENT DOCUMENTS

CN 202189952 4/2012

*Primary Examiner* — Ross Gushi

(74) *Attorney, Agent, or Firm* — Alix, Yale & Ristas, LLP

(57) ABSTRACT

A plug structure for connecting sockets comprises at least one jack formed at a side of a first socket; and a plug rod disposed on a second socket corresponding to the at least one jack and configured to plug in the at least one jack. The plug rod is electrically contacted with a spring piece in the jack so as to electrify the second socket. A slidable baffle plate is disposed on an inner side of the at least one jack and is configured to cover the jack. A through hole corresponding to the jack is formed in the baffle plate. A slope configured to push the baffle plate is disposed at a position on the baffle plate corresponding to the jack, and is disposed at an edge of the through hole and fitted with the plug rod to push the baffle plate to be inserted into the through hole. The plug structure for connecting sockets according to the present disclosure provides an improvement for a security protection of combined interfaces of the sockets, thus ensuring a security of the combined sockets.

15 Claims, 6 Drawing Sheets

(56) References Cited

U.S. PATENT DOCUMENTS

| | | | | |
|---|---|---|---|---|
| 7,488,204 | B2 * | 2/2009 | Hsu | 439/535 |
| 7,497,740 | B2 * | 3/2009 | Mei et al. | 439/652 |
| 7,575,470 | B2 * | 8/2009 | Pyrros | 439/535 |
| 7,607,928 | B2 * | 10/2009 | Schriefer et al. | 439/214 |
| 7,628,643 | B2 * | 12/2009 | Pyrros | 439/535 |
| 7,651,348 | B2 * | 1/2010 | Huang et al. | 439/137 |
| 7,820,909 | B2 * | 10/2010 | Castaldo et al. | 174/53 |
| 7,874,856 | B1 * | 1/2011 | Schriefer et al. | 439/214 |
| 8,221,131 | B1 * | 7/2012 | Mazyck | 439/13 |
| 8,226,444 | B2 * | 7/2012 | Chow | 439/651 |
| 8,242,362 | B2 * | 8/2012 | Castaldo et al. | 174/53 |
| 8,702,447 | B2 * | 4/2014 | Lau | 439/535 |
| 9,028,274 | B2 * | 5/2015 | Zien et al. | 439/527 |
| 9,059,529 | B1 * | 6/2015 | Lai | 1/1 |
| 9,059,530 | B2 * | 6/2015 | Byrne et al. | 1/1 |
| 2004/0203270 | A1 * | 10/2004 | Wang | 439/136 |
| 2007/0109710 | A1 * | 5/2007 | Milan | 361/118 |
| 2007/0178756 | A1 * | 8/2007 | Schriefer et al. | 439/535 |
| 2014/0350701 | A1 * | 11/2014 | Underwood | 700/83 |
| 2015/0099381 | A1 * | 4/2015 | Ma | 439/137 |

* cited by examiner

PLUG STRUCTURE FOR CONNECTING SOCKETS

FIELD

The present disclosure relates to an improvement of a socket structure, and more particularly relates to an improvement of a security structure of the socket which can plug in another socket.

BACKGROUND

Since a conventional socket has a fixed number and type of jacks, it is easy to cause a waste or a shortness of jacks due to different requirements for jacks and different numbers of electric appliances. For this, a socket device which can arbitrarily extend a number of jacks has been proposed, such as the socket device disclosed in Chinese Patent ZL201120198999.7, which realizes a plugging by providing a first socket having a plurality of jacks configured to plug with a second socket at one end side and a wire for connecting with the electric supply at the other end side and a second socket having a plurality of jacks at one side and a plug rod fitted with the plurality of jacks of the first socket at the other side. Thus, one first socket can be plugged with a plurality of second sockets sequentially.

However, in this conventional socket device, there is no security arrangement between the jack and the plug rod, and it is easy to cause accidents. Therefore, there is a need to improve and develop the conventional socket device.

SUMMARY

Briefly stated, a plug structure connects sockets, so as to improve a security of modularization combined sockets.

A plug structure for connecting sockets comprises at least one jack formed at a side of a first socket; and a plug rod disposed on a second socket corresponding to the at least one jack and configured to plug in the at least one jack. The plug rod is electrically contacted with a spring piece in the jack so as to electrify the second socket. A slidable baffle plate is disposed on an inner side of the at least one jack and is configured to cover the jack. A through hole corresponding to the jack is formed in the baffle plate. A slope configured to push the baffle plate is disposed at a position on the baffle plate corresponding to the jack and is disposed at an edge of the through hole and fitted with the plug rod to push the baffle plate to be inserted into the through hole.

For the plug structure, the baffle plate is disposed in a sliding groove on the outside of the jack, and an elastic member is disposed in the sliding groove for supporting the baffle plate.

For the plug structure, a number and a position of the through holes correspond to those of the at least one jack respectively.

For the plug structure, the slope is disposed in each of the through holes.

For the plug structure, the slope is disposed in the through hole without an electricity function. A non-conductive jack is disposed at the side of the first socket, and a non-conductive plug rod is disposed at a position on the second socket corresponding to the non-conductive jack.

For the plug structure, a number of jacks or plug rods disposed corresponding to the jacks is three or four.

For the plug structure, a plurality of jacks and a plurality of plug rods corresponding to the plurality of jacks are employed, and each of the first socket and the second socket is configured as a phone socket or a network socket.

The plug structure for connecting sockets according to the present disclosure realizes an improvement for a security protection of combined interfaces of the sockets, thus ensuring a security of the combined sockets.

DETAILED DESCRIPTION

Preferable embodiments of the present disclosure will be described in detail below.

Figure 11:
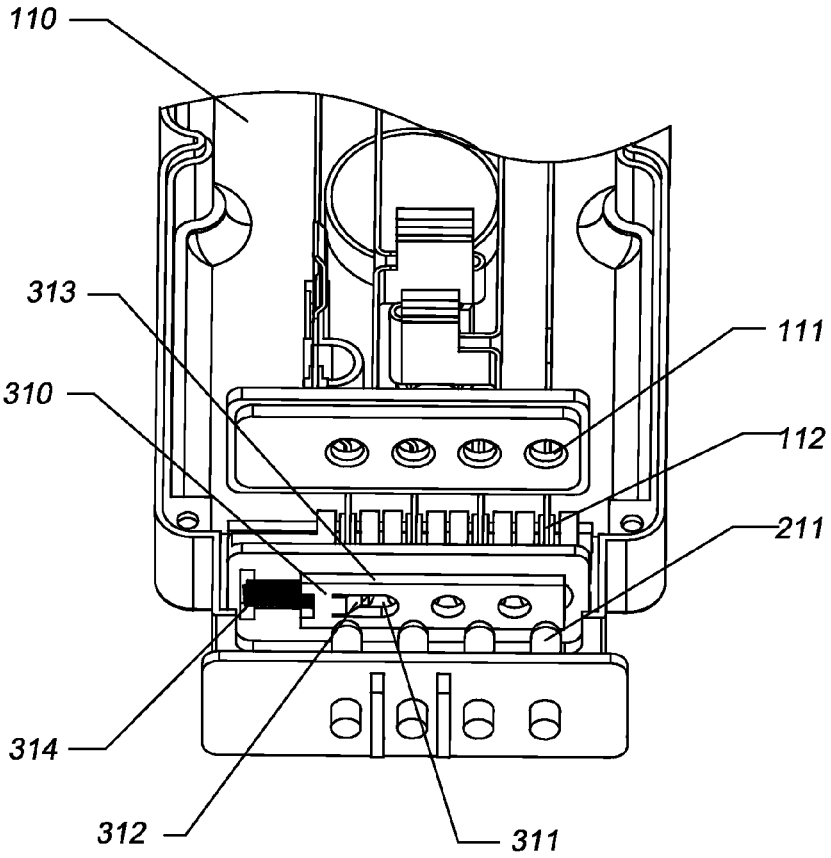
FIG. 11 is an exploded fragmentary perspective view of the socket according to the present disclosure.

As shown in FIG. 11, the plug structure for connecting sockets of the present disclosure comprises at least one jack 111 formed at a side of the first socket 110. These jacks are configured to be fitted with the plug rods 211 corresponding to the jacks 111 and disposed on the second socket 210 (not shown). The jack 111 is fitted with the plug rod 211 to be plugged in and ensure an electrical connection, thus sending the electric signal from the first socket to the second socket. Common jack units are disposed at upper surfaces of the first socket and the second socket. As shown in FIGS. 1-4, different types of jack units suitable for requirements of different countries are disposed at upper surfaces of the first socket and the second socket, and the numbers of the jack units are different. However, the present disclosure is not limited to these shown standard models, and the plug structure for connecting sockets of the present disclosure can be used for a variety of different standard models.

Figure 5:
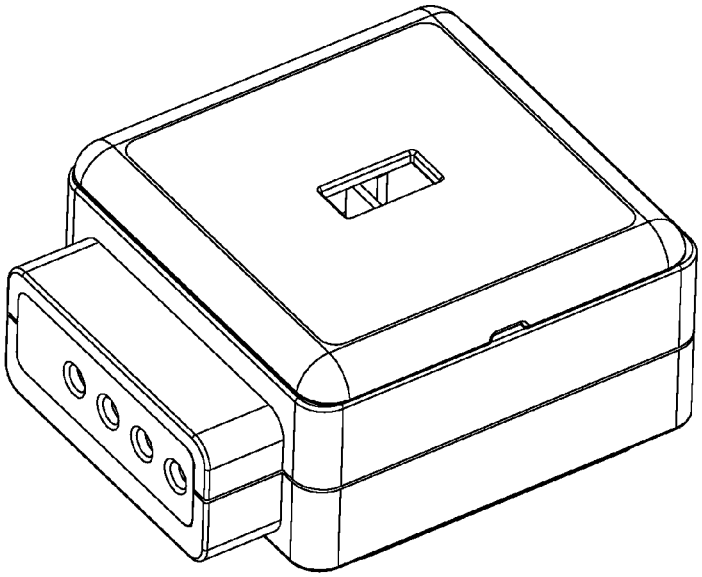
FIGS. 5-9 are perspective views showing a plurality of other preferable embodiments of the socket according to the present disclosure.
Figure 6:
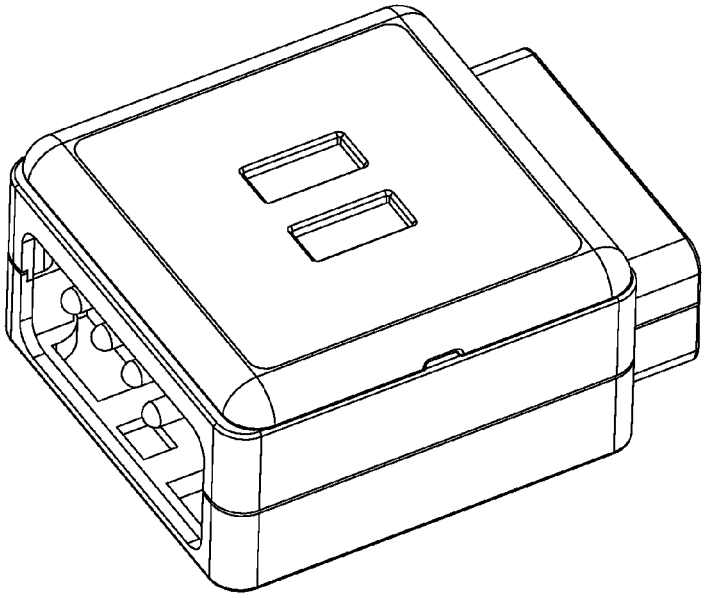
Figure 7:
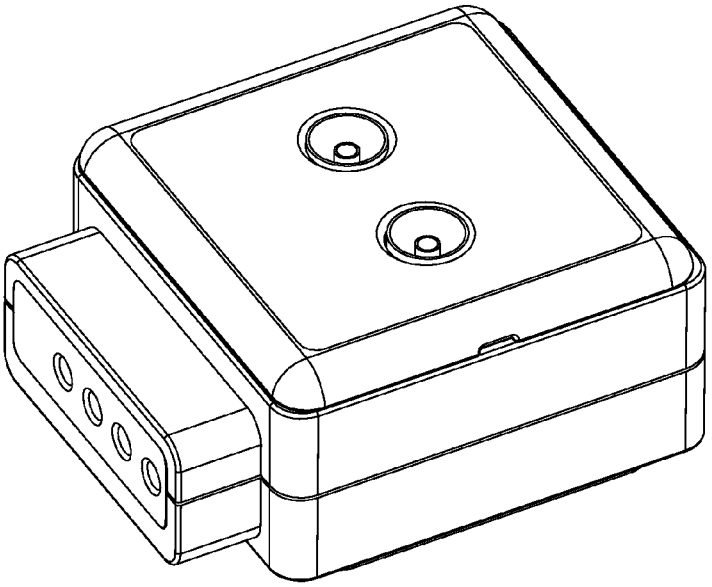
Figure 8:
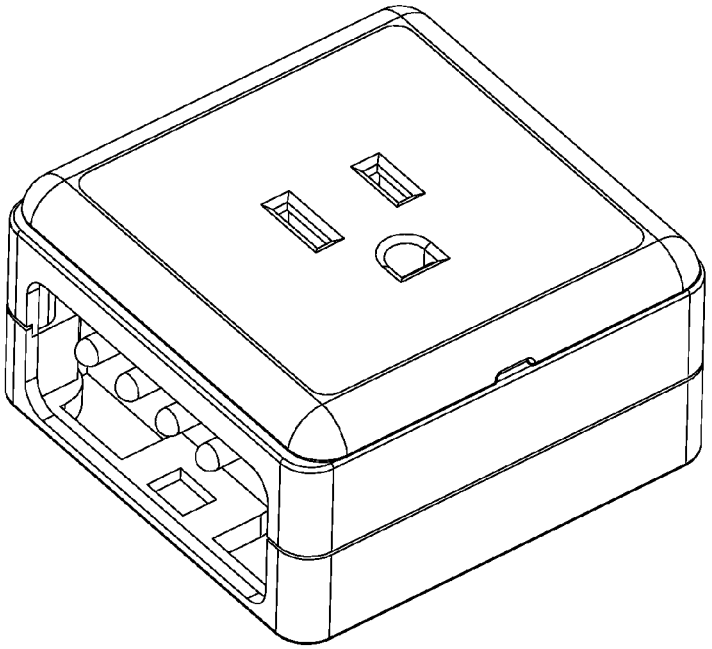
Figure 9:
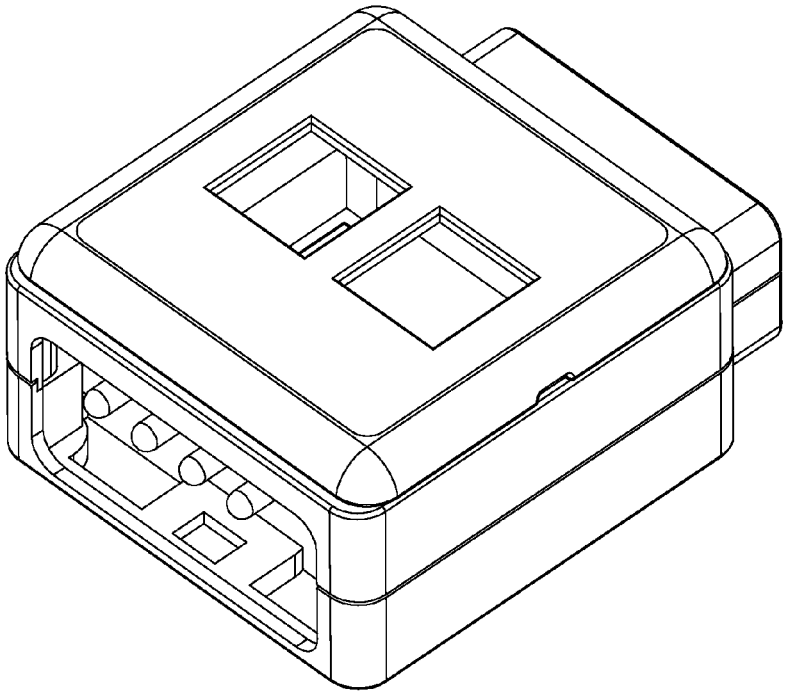

The second socket according to the present disclosure may be provided with the above jack at one side thereof and the above plug rod on the other side, thus forming a socket module which can be plugged sequentially. The present disclosure is mainly used in an extended jack of a power socket. The number of jacks or plug rods disposed corresponding to the jacks may be three or four, however, the number of jacks or plug rods disposed corresponding to the jacks may be any other value, such as six or eight. The socket may be configured as a phone socket or a network socket, as shown in FIG. 9. The socket may also be configured as an extended socket of a USB interface, as shown in FIG. 5 and FIG. 6. Alternatively, the socket may be configured as a VHF socket of a television, as shown in FIG. 7. The socket may be the socket of different standard models in different countries with a single jack unit, such as the power supply socket unit in America shown in FIG. 8.

Figure 1:
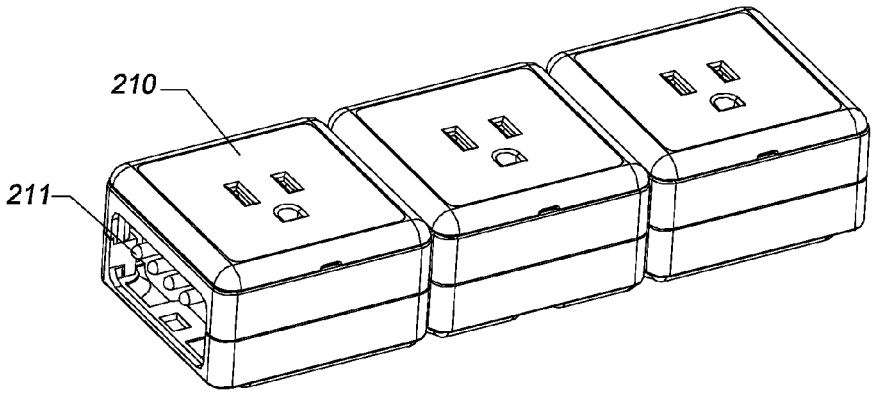
FIGS. 1-4 are perspective views showing a plurality of preferable embodiments of a socket according to the present disclosure.
Figure 2:
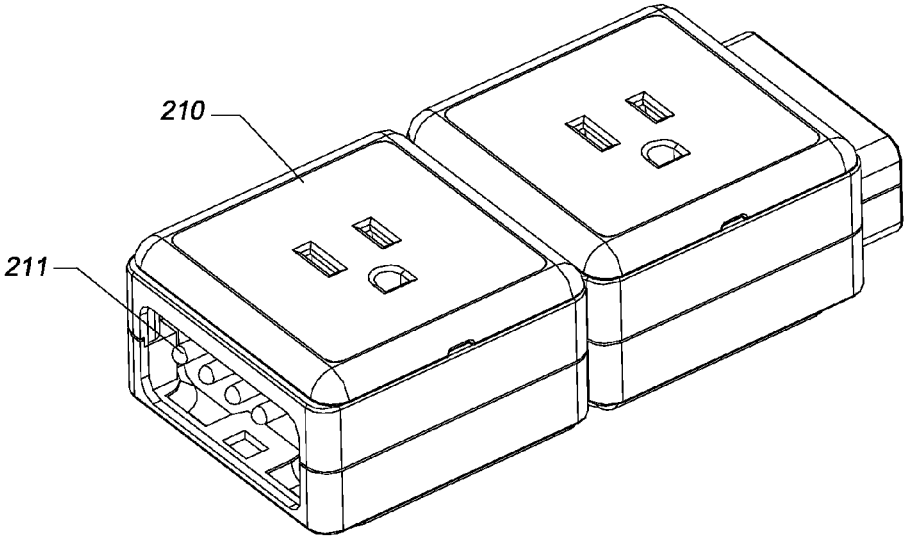
Figure 3:
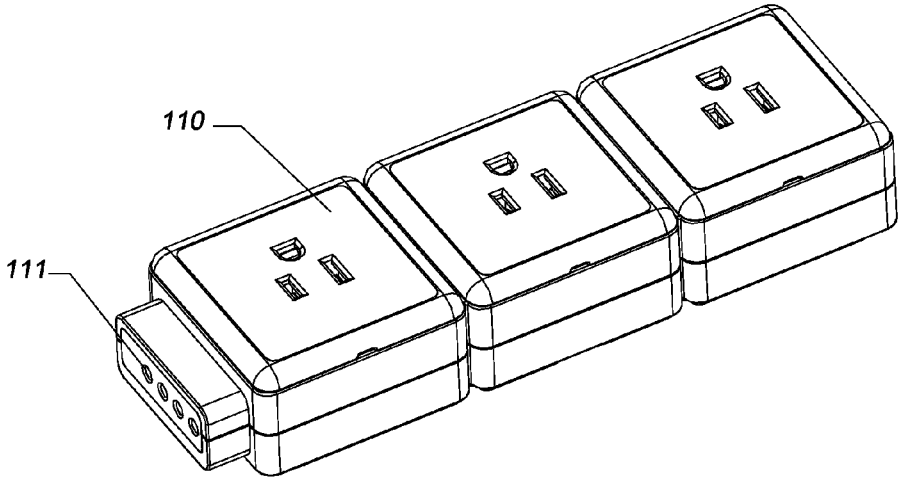
Figure 4:
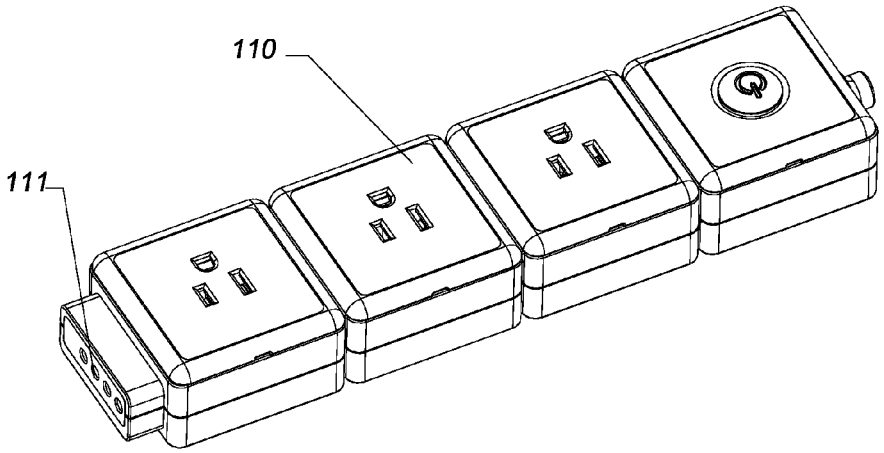

As shown in FIG. 4, a switch unit may be disposed on the first socket or the second socket, and a size of the switch unit may be similar to that of the jack unit.

Figure 10A:
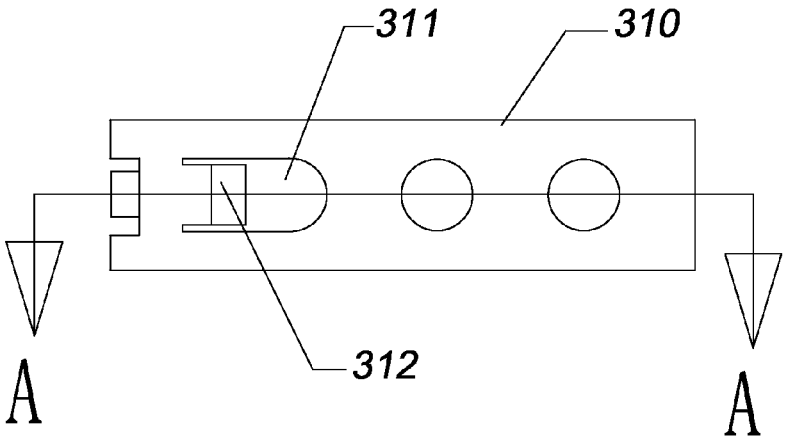
FIG. 10*a* and FIG. 10*b* are a front view and an A-A section view of a baffle plate according to the present disclosure.
Figure 10B:
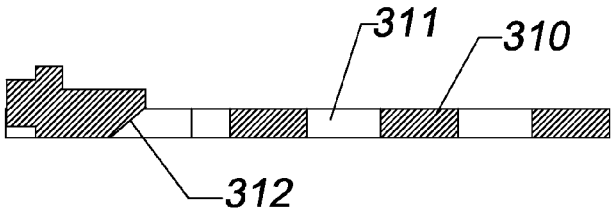

According to the present disclosure, the plug rod configured to plug in the jack is electrically contacted with the spring piece 112 in the jack, so as to electrify the second socket. A slidable baffle plate 310 is disposed on the inner side of the housing of the jack 111 of the first socket 110, as shown in FIG. 10*a* and FIG. 10*b*. The baffle plate 310 is configured to cover the jack 111, as shown in FIG. 11. The jack 111 is also provided with through holes 311 capable of communication with the jack 111, and a ramp or slope 312 is disposed at a side of one through hole. By fitting with a top end of the plug rod 211, the slope 312 can push the baffle plate 310 towards one side so as to make the through hole communicated with the corresponding jack 111, and meanwhile the plug rod 211 can pass through the through hole 311 to be inserted into the jack 111, thus forming an extended socket device.

Inside the jack 111, the baffle plate 310 is disposed in a sliding groove 313 formed between the housing and the inner plate, and a biasing member 314 is disposed in the sliding groove 313 for keeping the baffle plate biasingly covering the through hole 311, as shown in FIG. 11. The elastic member is preferably configured as a coil spring. A covering plate is disposed on the sliding groove 313, and the jack 111 is formed in the covering plate.

With the plug structure for connecting sockets according to the present disclosure, since all the jacks 111 are covered by the baffle plate (at this time, the biasing member keeps the baffle plate in the covering position) before inserting the plug rod of the second socket into the jack at the side of the first socket, all the spring pieces in the jacks are covered, thus reducing the risk of electric leakage. By disposing the ramp or slope on the side of at least one through hole in the baffle plate, when the plug rod is inserted into the jack, the top end of the plug rod corresponding to the slope will press the baffle plate downwards along the slope, so as to move the baffle plate towards one side until the through hole in the baffle plate is communicated with the jack, thus inserting the plug rod downwards into the corresponding jack.

In the preferable embodiment of the socket according to the present disclosure, the ramp or slope may be disposed in the through hole without an electricity function, and corresponding to the through hole without the electricity function, a non-conductive jack is formed at the plug side of the first socket, and a non-conductive plug rod is disposed at a position on the second socket corresponding to the non-conductive jack. Thus, it is possible to ensure that the non-conductive plug rod is firstly inserted into the jack and the inserted plug rod does not have the conductive function, so that other plug rods realizing the conductive function are inserted into the jacks through a relatively small gap, thus further reducing the risk of electric leakage.

According to the present disclosure, one baffle plate may be disposed corresponding to each jack, however, it is preferred to provide one baffle plate corresponding to a plurality of jacks, and the number of jacks may be three or four.

With the plug structure of the connecting sockets according to the present disclosure, by using the slidable baffle plate disposed on the side of the jack and disposing the non-conductive jack and plug rod used as the driving structure for the baffle plate, the firstly inserted plug rod does not need to realize the conductive function, thus reducing the electric leakage when the conductive plug rod is plugged into the conductive jack. The plug structure according to the present disclosure not only can be used in the common power supply socket, but also can be used for extending the phone socket or the network socket.

It should be understood by those skilled in the art that modifications or alternatives may be made according to the above description, and all these modifications and alternatives fall into the scope of the appended claims. Additionally, the first socket and the second socket defined in the present application is just for convenient understanding, it should be noted that, there are no limitations on the number of the first sockets and the second sockets in the plug structure for connecting sockets according to embodiments of the present disclosure, and the number of the first sockets and the second sockets can be determined freely according to the actual requirements.

The invention claimed is:

1. A plug structure for connecting sockets, comprising:

at least one jack formed at a side of a first socket; and a plug rod disposed on a second socket corresponding to the at least one jack and configured to plug in the at least one jack, wherein the plug rod is electrically contacted with a spring piece in the jack so as to electrify the second socket, wherein a slidable baffle plate is disposed on an inner side of the at least one jack and configured to cover the jack; a through hole corresponding to the jack is defined in the baffle plate; and a slope configured to push the baffle plate is disposed at a position on the baffle plate corresponding to the jack, disposed at an edge of the through hole and fitted with the plug rod to push the baffle plate to be inserted into the through hole.

2. The plug structure according to claim 1, wherein a number of jacks or plug rods disposed corresponding to the jacks is three or four.

3. The plug structure according to claim 1, wherein a plurality of jacks and a plurality of plug rods corresponding to the plurality of jacks are disposed, and each of the first socket and the second socket is configured as a phone socket or a network socket.

4. The plug structure according to claim 1, wherein the baffle plate is disposed in a sliding groove on the outside of the jack, and a biasing member is disposed in the sliding groove for supporting the baffle plate.

5. The plug structure according to claim 4, wherein a number of jacks or plug rods disposed corresponding to the jacks is three or four.

6. The plug structure according to claim 4, wherein a plurality of jacks and a plurality of plug rods corresponding to the plurality of jacks are disposed, and each of the first socket and the second socket is configured as a phone socket or a network socket.

7. The plug structure according to claim 1, wherein a number and a position of the through holes are corresponding to those of the at least one jack respectively.

8. The plug structure according to claim 7, wherein the slope is disposed in each of the through holes.

9. The plug structure according to claim 8, wherein a number of jacks or plug rods disposed corresponding to the jacks is three or four.

10. The plug structure according to claim 7, wherein a plurality of jacks and a plurality of plug rods corresponding to the plurality of jacks are disposed, and each of the first socket and the second socket is configured as a phone socket or a network socket.

11. The plug structure according to claim 8, wherein a plurality of jacks and a plurality of plug rods corresponding to the plurality of jacks are disposed, and each of the first socket and the second socket is configured as a phone socket or a network socket.

12. The plug structure according to claim 7, wherein the slope is disposed in the through hole without an electricity function, a non-conductive jack is disposed at the side of the first socket, and a non-conductive plug rod is disposed at a position on the second socket corresponding to the non-conductive jack.

13. The plug structure according to claim 12, wherein a number of jacks or plug rods disposed corresponding to the jacks is three or four.

14. The plug structure according to claim 12, wherein a plurality of jacks and a plurality of plug rods corresponding to the plurality of jacks are disposed, and each of the first socket and the second socket is configured as a phone socket or a network socket.

15. The plug structure according to claim 7, wherein a number of jacks or plug rods disposed corresponding to the jacks is three or four.

* * * * *